US012172063B1

(12) United States Patent
Zhang

(10) Patent No.: US 12,172,063 B1
(45) Date of Patent: Dec. 24, 2024

(54) NET FRAME STRUCTURE WITH ADJUSTABLE NET HEIGHT

(71) Applicant: Shanghai Aodao Technology Co., Ltd., Shanghai (CN)

(72) Inventor: Liang Zhang, Tangshan (CN)

( * ) Notice: Subject to any disclaimer, the term of this patent is extended or adjusted under 35 U.S.C. 154(b) by 0 days.

(21) Appl. No.: 18/614,672

(22) Filed: Mar. 23, 2024

(51) Int. Cl.
*A63B 61/02* (2006.01)

(52) U.S. Cl.
CPC ..... *A63B 61/02* (2013.01); *A63B 2225/093* (2013.01); *A63B 2243/0095* (2013.01)

(58) Field of Classification Search
CPC ..... A63B 61/02; A63B 2225/093; A63B 2243/0095
See application file for complete search history.

(56) References Cited

U.S. PATENT DOCUMENTS

2008/0274841 A1* 11/2008 Underwood ..... A63B 61/02 473/492
2011/0230284 A1* 9/2011 Simon ..... A63B 61/02 248/188.7

FOREIGN PATENT DOCUMENTS

CN 213609699 U * 7/2021

* cited by examiner

*Primary Examiner* — Jeffrey S Vanderveen

(57) ABSTRACT

The present application provides a net frame structure with an adjustable net height, the net frame structure comprising: a net, a suspending member being provided on each of left and right sides of the net; and two support members respectively arranged on the left and right sides of the net in an extended state, wherein each of the support members is provided with a plurality of height positioning portions, the plurality of height positioning portions are sequentially arranged at intervals in a height direction of the support member, a height at which each height positioning portion is located corresponds to a standard height of the net, and the height positioning portion is detachably connected to the suspending member, enabling the net to be maintained at a desired standard height. When the height of the net needs to be adjusted, it is only necessary to connect the suspending member on the net to a height positioning portion corresponding to the desired standard height, thus allowing the actual height of the net to correspond to the desired standard height, avoiding fluctuations of the actual height of the net, improving the height adjustment accuracy of the net, providing a simple structure, and making operations easy.

9 Claims, 4 Drawing Sheets

NET FRAME STRUCTURE WITH ADJUSTABLE NET HEIGHT

TECHNICAL FIELD

The present application relates to a net frame structure, and in particular to a net frame structure with an adjustable net height.

BACKGROUND ART

At present, a height of a net in a net frame structure for volleyballs in the market is generally adjusted by means of a slidable structure. During adjusting, the height of the net can only be adjusted subjectively and experientially, resulting in the net having a higher or lower actual height than a standard height, which is not accurate enough, such that the offensive and defensive balance in a game and the players' play are influenced. For example, if the net height is higher, it would be easier for an attacker to smash and score, which would break the offensive and defensive balance in the game, and if the net height is lower, it would be easier for a defender to block and score, which would also break the offensive and defensive balance in the game.

SUMMARY

An embodiment of the present application provides a net frame structure with an adjustable net height, in order to solve the problems existing in related art. A technical solution thereof is described as follows.

An embodiment of the present application provides a net frame structure with an adjustable net height, the net frame structure including:

a net, a suspending member being provided on each of left and right sides of the net; and two support members respectively arranged on the left and right sides of the net in an extended state, wherein each of the support members is provided with a plurality of height positioning portions, the plurality of height positioning portions are sequentially arranged at intervals in a height direction of the support member, a height at which each height positioning portion is located corresponds to a standard height of the net, and the height positioning portion is detachably connected to the suspending member, enabling the net to be maintained at a desired standard height.

In an implementation, the height positioning portion is provided with a limiting groove, the height positioning portion is detachably connected to the suspending member by means of the limiting groove, and the limiting groove is capable of limiting a movement of the suspending member in the height direction of the support member.

In an implementation, the suspending member is of a flexible structure and is provided with a suspending hole, the suspending hole penetrates through the suspending member from top to bottom, the suspending hole extends in a left-right direction of the net, and the suspending hole has a first state in which a width of the suspending hole in a front-rear direction of the net is greater than a maximum outer diameter of the height positioning portion and a second state in which the width of the suspending hole in the front-rear direction of the net is less than the maximum outer diameter of the height positioning portion; when the suspending hole is in the first state, the suspending hole allows the height positioning portion to enter and exit therethrough, so as to allow the suspending member to move vertically along the support member; and when the suspending hole is in the second state, the suspending member is detachably connected to the limiting groove, so as to limit the movement of the suspending member in the height direction of the support member.

In an implementation, the height positioning portion includes:

an upper limiting portion, the upper limiting portion having a greater outer diameter than the support member; and a lower limiting portion, the lower limiting portion having a greater outer diameter than the support member, and the lower limiting portion and the upper limiting portion being arranged spaced apart from each other in the height direction of the support member to form the limiting groove.

In an implementation, the outer diameter of the upper limiting portion is gradually increased from top to bottom, and the outer diameter of the lower limiting portion is gradually increased from bottom to top.

In an implementation, the support member has a first state in which an upper portion of the support member is close to the net in the left-right direction of the net and a second state in which the upper portion of the support member is away from the net in the left-right direction of the net, and the support member is maintained in the second state under the action of the elasticity of the support member;

when the support member is in the first state, the net is slacked, allowing the suspending hole to move vertically along the support member; and when the support member is in the second state, the net is tensioned to cause the suspending member to be connected to the limiting groove.

In an implementation, the suspending member is located at an upper end of the net;

a tension rope is arranged at each of lower ends of two sides of the net in the left-right direction, a support portion is arranged on each support member, and the support portion is connected to a corresponding tension rope; and when the suspending member is connected to the height positioning portion, and the tension rope is connected to the support portion, the net is tensioned.

In an implementation, the tension rope is of a length adjustable structure, and the tension rope is movably connected to the support portion.

In an implementation, the tension rope includes:

an adjustment tension buckle, the adjustment tension buckle being provided with a plurality of perforations, and the plurality of perforations being sequentially arranged in a vertical direction; and a rope body, the rope body having a first connection section, a second connection section and a third connection section, wherein a head end of the first connection section is connected to the net, a tail end of the first connection section is connected to a head end of the second connection section, the second connection section is staggered from top to bottom and movably threaded in the plurality of perforations, a tail end of the second connection section is connected to a head end of the third connection section, a tail end of the third connection section is connected to the second connection section, and a portion between the head end and the tail end of the third connection section is movably suspended from the support portion.

In an implementation, the net frame structure further includes:

a bottom frame, the bottom frame being of a telescopic structure that is extendable and retractable in a left-right direction of the net frame structure, wherein a connecting portion is arranged at each of left and right ends of the bottom frame, and each connecting portion is detachably connected to a lower end of a corresponding support member.

The above technical solution has at least the following advantages and beneficial effects.

In the net frame structure with an adjustable net height of the present application, the support member is provided with the plurality of height positioning portions, and each height positioning portion corresponds to a standard height of the net, such that a plurality of standard height references are integrated on the support member. Therefore, when the height of the net needs to be adjusted, it is only necessary to connect the suspending member on the net to a height positioning portion corresponding to the desired standard height, thus allowing the actual height of the net to correspond to the desired standard height, avoiding fluctuations of the actual height of the net, improving the height adjustment accuracy of the net, providing a simple and practical structure, and making operations easy.

The above description is merely presented for the purpose of illustration, and is not intended to limit the present disclosure in any way. Except for the above illustrative aspects, implementations and features, further aspects, implementations and features of the present application will become readily apparent with reference to the accompanying drawings and the following detailed description.

BRIEF DESCRIPTION OF THE DRAWINGS

In figures, the same reference numerals denote the same or similar components or elements throughout a plurality of figures unless otherwise specified. These figures are not necessarily drawn to scale. It should be understood that these figures depict only some implementations disclosed according to the present application and are not to be construed as limiting the scope of the present application.

LIST OF REFERENCE SIGNS

Figure 1:
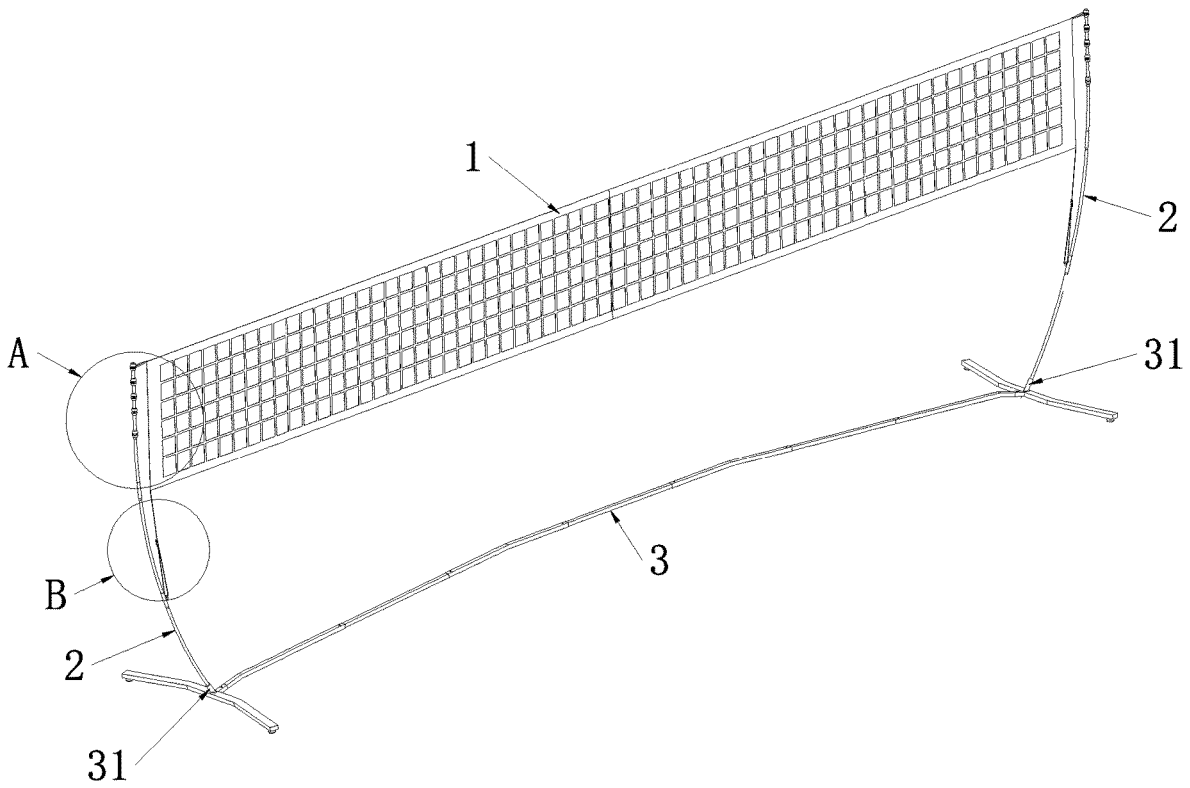
FIG. 1 is a schematic perspective structural diagram of a net frame structure with an adjustable net height of the present application from a first perspective.

1. Net; 11. Suspending member; 111. Suspending hole; 12. Tension rope; 121. Adjustment tension buckle; 1211. Perforation; 122. Rope body; 1221. First connection section; 1222. Second connection section; 1223. Third connection section; 2. Support member; 21. Height positioning portion; 211. Limiting groove; 212. Upper limiting portion; 213. Lower limiting portion; 22. Support portion; 3. Bottom frame; 31. Connecting portion.

DETAILED DESCRIPTION OF EMBODIMENTS

Only some exemplary embodiments are briefly described below. As can be appreciated by those skilled in the art, modifications may be made to the described embodiments in various ways without departing from the spirit or scope of the present application. Therefore, the accompanying drawings and the description are considered as exemplary in nature rather than limiting.

FIGS. 1-4 illustrate a net frame structure with an adjustable net height according to a preferred implementation of the present application, the net frame structure including: a net 1, a suspending member 11 being provided on each of left and right sides of the net 1; and two support members 2 respectively arranged on the left and right sides of the net 1 in an extended configuration, wherein each of the support members 2 is provided with a plurality of height positioning portions 21, the plurality of height positioning portions 21 are sequentially arranged at intervals in a height direction of the support member 2, a height at which each height positioning portion 21 is located corresponds to a standard height of the net 1, and the height positioning portion 21 is detachably connected to the suspending member 11, enabling the net 1 to be maintained at a desired standard height.

In the net frame structure with an adjustable net height of the present application, the support member 2 is provided with the plurality of height positioning portions 21, and each height positioning portion 21 corresponds to a standard height of the net 1, such that a plurality of standard height references are integrated on the support member 2. Therefore, when the height of the net 1 needs to be adjusted, it is only necessary to connect the suspending member 11 on the net 1 to a height positioning portion 21 corresponding to the desired standard height, thus allowing the actual height of the net 1 to correspond to the desired standard height, avoiding fluctuations of the actual height of the net 1, improving the height adjustment accuracy of the net 1, providing a simple and practical structure, and making operations easy.

Figure 2:
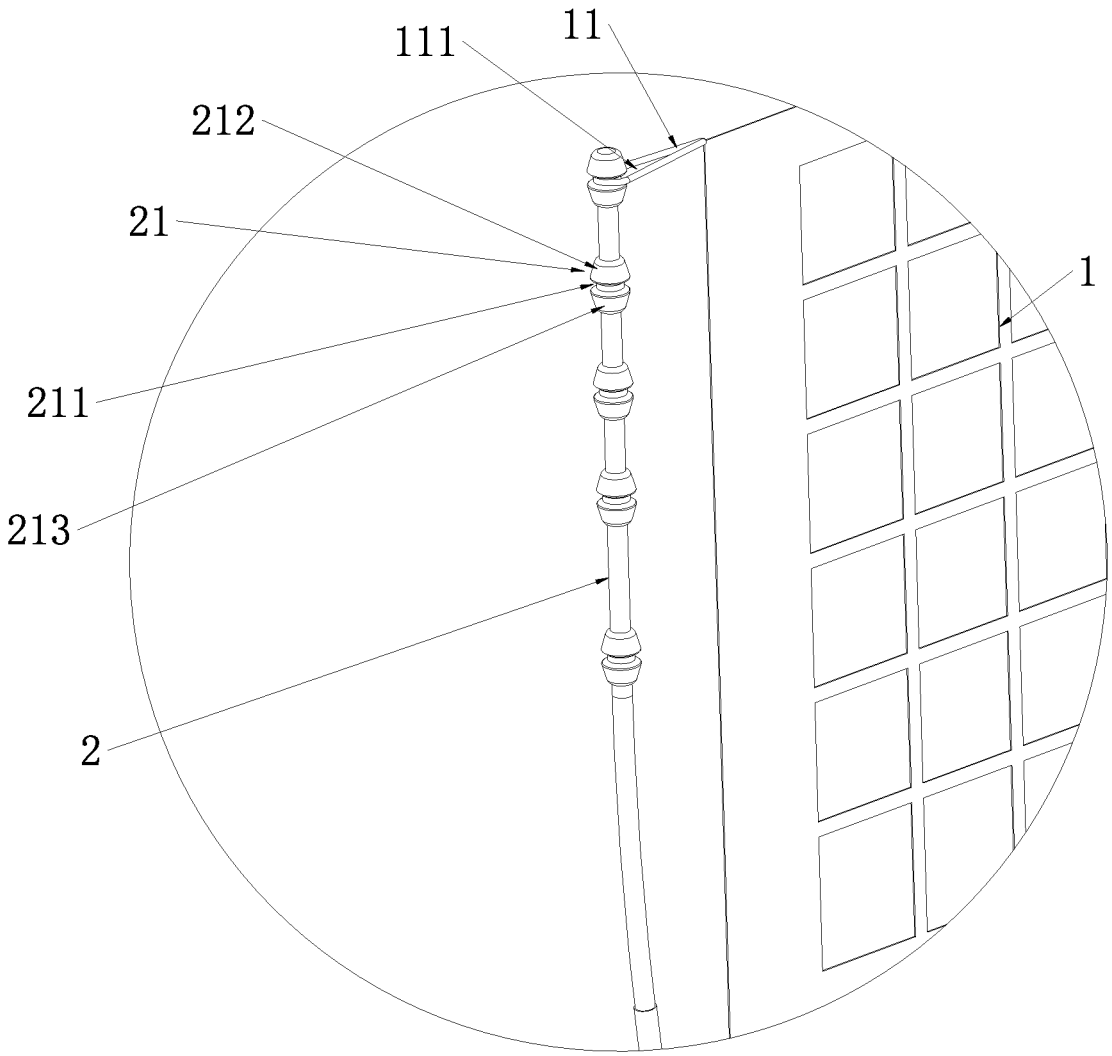
FIG. 2 is a partially enlarged view of part A of FIG. 1.

In the technical field of volleyballs, different heights are required to be suitable for a men's game, a women's game, a mixed game, a young men's game, and a young women's game, the net frame structure enable the net 1 to be adjusted more conveniently and rapidly to different heights that are suitable for different groups of players. Referring to FIGS. 1 and 2, the support member 2 is provided with five height positioning portions 21, when the net frame structure is applied to the technical field of volleyballs, the five height positioning portions 21 are adapted to a standard height of eight feet for a men's game, a standard height of seven feet and eight inches for a mixed game, a standard height of seven feet and four inches for a women's game, a standard height of seven feet for young men's game and a standard height of six feet and six inches for a young women's game in one-to-one correspondence, that is, the net frame structure is a five-level height adjustment structure.

Of course, in other implementations, two, three, four or more than six height positioning portions 21 may be provided.

Of course, in other implementations, the net frame structure may also be used in baseball training, game net frame and for other purposes.

Referring to FIG. 2, in an implementation, the height positioning portion 21 is provided with a limiting groove 211, the height positioning portion 21 is detachably connected to the suspending member 11 by means of the limiting groove 211, and the limiting groove 211 can limit a movement of the suspending member 11 in the height direction of the support member 2 to allow the net 1 to be maintained at a desired standard height. The height positioning portion 21 is in detachably connected to the suspending member 11 by means of a groove, which provides a simple and practical structure, and makes operations simple and easy, such that the height adjustment efficiency of the net 1 can be improved, and the cost is low, which can reduce the overall cost of the net frame structure.

Referring to FIG. 2, in an implementation, the suspending member 11 is of a flexible structure, and the suspending member 11 is provided with a suspending hole 111, wherein the suspending hole 111 penetrates through the suspending member 11 from top to bottom, the suspending hole 111 extends in a left-right direction of the net 1, and the suspending hole 111 has a first state in which a width of the suspending hole in a front-rear direction of the net 1 is greater than a maximum outer diameter of the height positioning portion 21 and a second state in which the width of the suspending hole in the front-rear direction of the net is less than the maximum outer diameter of the height positioning portion 21.

When the suspending hole 111 is in the first state, the suspending hole 111 allows the height positioning portion 21 to enter and exit therethrough, so as to cause the suspending member 11 to move in the height direction of the support member 2; and when the suspending hole 111 is in the second state, the suspending member 11 is detachably connected to the limiting groove 211, so as to limit the movement of the suspending member 11 in the height direction of the support member 2. Since the suspending member 11 is of a flexible structure, the suspending member 11 can deform such that the width of the suspending hole 111 in the front-rear direction of the net 1 can be switched between the first state and the second state and thus the height position of the suspending member 11 on the support member 2 can be adjusted without disengaging the suspending member 11 from the support member 2, which makes the adjustment easier and achieves increased adjustment efficiency. In addition, the suspending member 11 can be switched from the first state to the second state by tensioning the suspending member 11 in a direction away from the net 1 in the left-right direction of the net 1, which causes the suspending member 11 to be reliably sleeved on the limiting groove 211 of the height positioning portion 21. The structure is simple and practical and operations are simple and easy such that the adjustment efficiency can be further improved, and the cost is lower, which facilitating a further reduction of the overall cost of the net frame structure.

Of course, in other implementations, the suspending member 11 may also be a suspending rope, and the suspending rope may be connected to the height positioning portion 21 by means of binding an end of the suspending rope away from the net 1 in the limiting groove 211, and the suspending rope may be disconnected from the height positioning portion 21 by means of disconnecting the end of the suspending rope away from the net 1 from the limiting groove 211.

In an implementation, the suspending member 11 may be a rope body 122 made of natural fiber material, synthetic fiber material, etc., or a structure made of flexible plastic material.

Of course, in other implementations, the suspending member 11 may be a deformable wire rope.

Referring to FIG. 2, in an implementation, the height positioning portion 21 includes:

an upper limiting portion 212, the upper limiting portion 212 having a greater outer diameter than the support member 2; and a lower limiting portion 213 having a greater outer diameter than the support member 2, wherein the lower limiting portion 213 and the upper limiting portion 212 are arranged spaced apart from each other in the height direction of the support member 2 to form the limiting groove 211, that is, when the suspending member 11 is sleeved on the height positioning portion 21, the upper limiting portion 212 limits the upward movement of the suspending member 11, and the lower limiting portion 213 limits the downward movement of the suspending member 11, thereby limiting the upward and downward movements of the suspending member 11 along the support member 2, so as to allow the net 1 to be reliably maintained at a desired standard height position. The height positioning portion 21 has a simple and practical structure and a high positioning reliability.

Referring to FIG. 2, in an implementation, the outer diameter of the upper limiting portion 212 is gradually increased from top to bottom, and the outer diameter of the lower limiting portion 213 is gradually increased from bottom to top. In this way, an end of the upper limiting portion 212 that has a larger outer diameter may be close to the lower limiting portion 213 and an end of the lower limiting portion 213 that has a large outer diameter may be close to the upper limiting portion 212, such that the upward and downward movements of the suspending member 11 are limited by means of the end of the upper limiting portion 212 that has the larger outer diameter and the end of the lower limiting portion 213 that has the larger outer diameter. In addition, a tapered surface of the upper limiting portion 212 and a tapered surface of the lower limiting portion 213 may be used to guide the movement of the suspending member 11, so as to allow the suspending member 11 to be more easily caught into the limiting groove 211, which in turn facilitates an increase in the adjustment efficiency.

Of course, in other implementations, both the upper limiting portion 212 and the lower limiting portion 213 may be of a columnar structure.

In an implementation, the support member 2 has a first state in which an upper portion of the support member is close to the net 1 in the left-right direction of the net 1 and a second state in which the upper portion of the support member is away from the net 1 in the left-right direction of the net 1, and the support member 2 is maintained in the second state under the action of the elasticity of the support member.

In the first state of the support member 2, the net 1 is slacked to allow the suspending hole 111 to move vertically along the support member 2, that is, the suspending member 11 is slacked, such that the width of the suspending hole 111 in the front-rear direction of the net 1 is greater than the outer diameter of the height positioning portion 21, thus allowing the suspending hole 111 to move vertically along the support member 2.

In the second state of the support member 2, the net 1 is tensioned to cause the suspending member 11 to be connected to the limiting groove 211, that is, the suspending member 11 is tensioned, such that the width of the suspending hole 111 in the front-rear direction of the net 1 is less than the outer diameter of the height positioning portion 21, thus limiting the upward and downward movements of the suspending member 11 by means of the height positioning portion 21.

Of course, in other implementations, the height positioning portion 21 and the suspending member 11 may also be connected together by means of a detachable connection structure such as a bolt and a hook-and-loop fastener.

Figure 4:
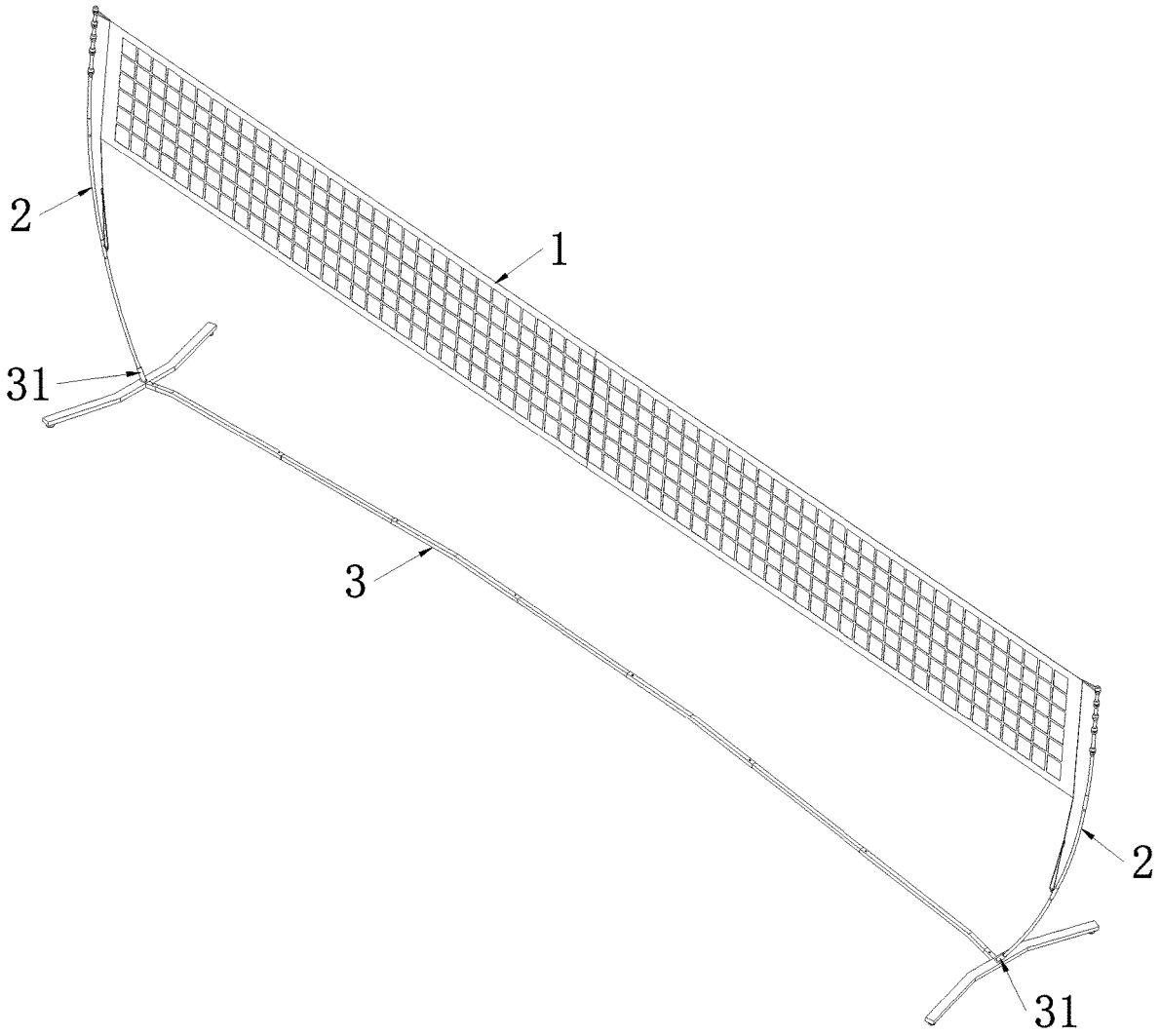
FIG. 4 is a schematic perspective structural diagram of a net frame structure with an adjustable net height of the present application from a second perspective.

Referring to FIGS. 1 and 4, in an implementation, the suspending member 11 is located at an upper end of the net 1;

a tension rope 12 is arranged at each of lower ends of two sides of the net 1 in the left-right direction, a support portion 22 is provided on each support member 2, and the support portion 22 is located below the height positioning portion 21 and is connected to a corresponding tension rope 12; and when the suspending member 11 is connected to the height positioning portion 21, and the tension rope 12 is connected to the support portion 22, the net 1 is tensioned and the net 1 can thus block a volleyball, and when the height position of the suspending member 11 on the support member 2 is adjusted, the net 1 may be maintained in a tensioned state by means of adjusting the length of the tension rope 12, which makes adjustment operations simple and easy and provides an increased adjustment efficiency.

Of course, in other implementations, the suspending members 11 described above may also be arranged at the lower ends of the left and right sides of the net 1, and correspondingly, the support member 2 is provided with a plurality of adjustment portions which are arranged below the height positioning portion 21 and sequentially arranged in the height direction of the support member 2. The specific structure of each of the adjustment portions is the same as that of the height positioning portion 21, and the adjustment portion is detachably connected to a corresponding suspending member 11. In this way, the net 1 can also be maintained in the tensioned state.

Figure 3:
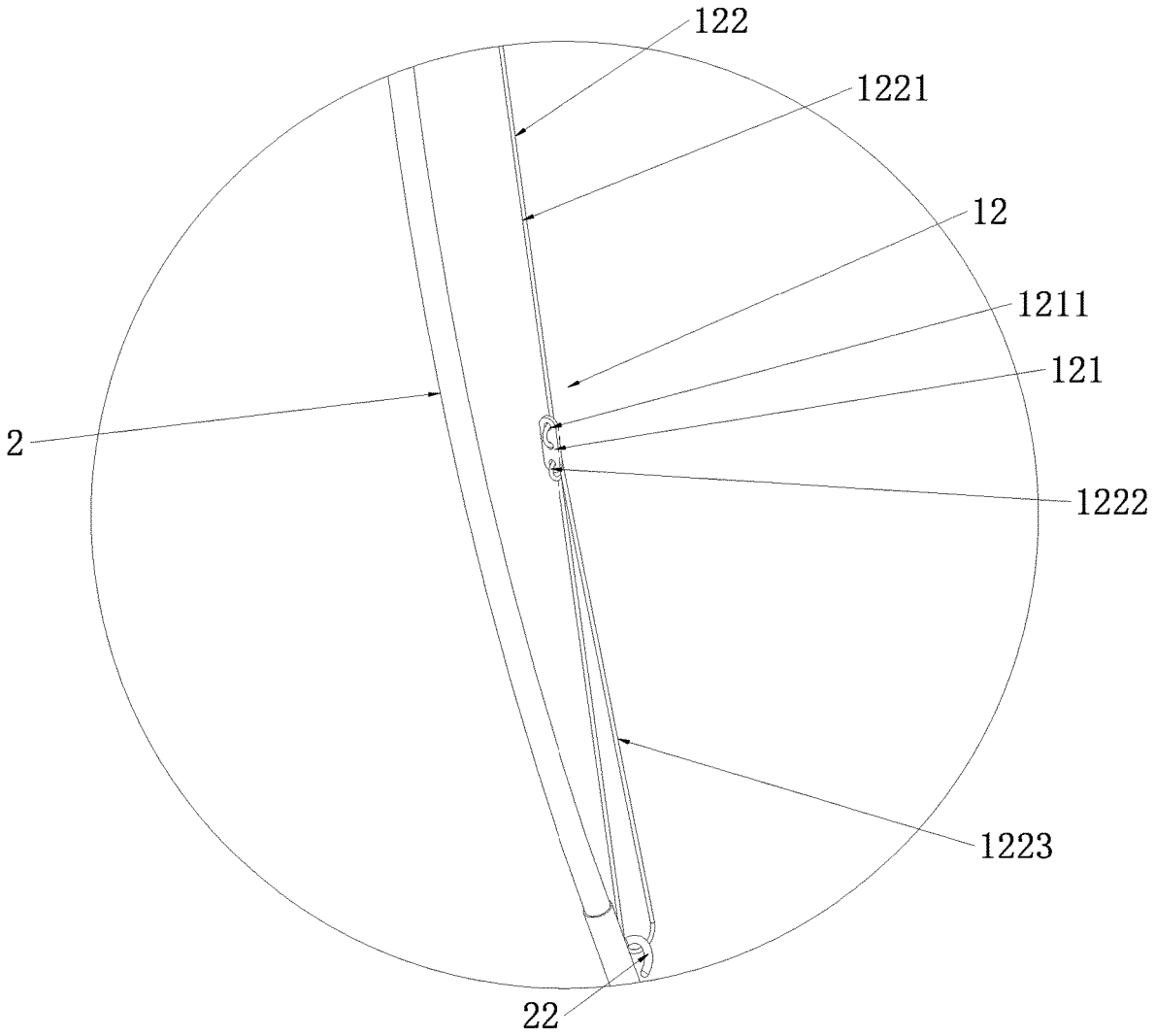
FIG. 3 is a partially enlarged view of part B of FIG. 1.

Referring to FIG. 3, in an implementation, the tension rope 12 is of an adjustable length structure, and the tension rope 12 is movably connected to the support portion 22. In this way, after the suspending member 11 is adjusted to the desired height position, the net 1 may be maintained in the tensioned state by means of adjusting the length of the tension rope 12, which makes operations simpler and easier and provides an increased adjustment efficiency. During the adjustment of the length of the tension rope 12, the tension rope 12 moves on the support portion 22 to enable the tension rope 12 to be tensioned or slacked, that is, to allow to increase or reduced the length of the tension rope 12.

Of course, in other implementations, the tension rope 12 may be a common rope without the function of length adjustment. In this case, the tension rope 12 may be shortened by means of winding the part of the tension rope 12 close to an end connected to the support portion 22 around the support portion 22, and the tension rope 12 may be lengthened by means of unwinding the part of the tension rope 12 close to the end connected to the support portion 22 and wound around the support portion 22.

Referring to FIG. 3, in an implementation, the tension rope 12 includes:

an adjustment tension buckle 121, the adjustment tension buckle 121 being provided with a plurality of perforations 1211, and the plurality of perforations 1211 being sequentially arranged in a vertical direction; and a rope body 122, the rope body 122 having a first connection section 1221, a second connection section 1222 and a third connection section 1223, wherein a head end of the first connection section 1221 is connected to the net 1, a tail end of the first connection section 1221 is connected to a head end of the second connection section 1222, the second connection section 1222 is staggered from top to bottom and movably threaded in the plurality of perforations 1211, a tail end of the second connection section 1222 is connected to a head end of the third connection section 1223, a tail end of the third connection section 1223 is connected to the second connection section 1222, and a portion between the head end and the tail end of the third connection section 1223 is movably suspended from the support portion 22. In this way, the first connection section 1221 may be lengthened by means of upwardly moving the adjustment tension buckle 121, causing the length of the tension rope 12 to be increased, and the first connection section 1221 may be shortened by means of downwardly moving the adjustment tension buckle 121, causing the length of the tension rope 12 to be reduced.

Referring to FIG. 3, in an implementation, the support portion 22 is specifically a hook to connect the tension rope 12 and the support portion 22 together reliably, preventing the tension rope 12 from being separated from the support portion 22.

Referring to FIGS. 1 and 4, in an implementation, the net frame structure further includes:

a bottom frame 3, the bottom frame 3 being of a telescopic structure that is extendable and retractable in the left-right direction of the net frame structure, that is, the bottom frame 3 having an extended state in which the two support members 2 can be arranged spaced apart from each other in the left-right direction of the net 1 and the net 1 can be tensioned, and a retracted state in which the bottom frame can be retracted for case of handling and storage, wherein a connecting portion 31 is arranged at each of left and right ends of the bottom frame 3, and each connecting portion 31 is detachably connected to a lower end of a corresponding support member 2. That is to say, the bottom frame 3 is a support base for the net 1 and the support member 2. When the bottom frame 3 is placed on and fixed to the ground, the net frame structure may be reliably erected on the ground, ensuring that the net 1 would not be knocked down by a volleyball when blocking the volleyball. Thanks to the telescopic structure of the bottom frame 3, the bottom frame 3 may be retracted for case of handling and storage and is easy to use, and since the support member 2 is detachably connected to the bottom frame 3, the support member 2 can be separated from the bottom frame 3, further facilitating the handling and storage of the net frame structure and making use easier.

Specifically, the above connecting portion 31 is provided with a hole, and the lower end of the support member 2 is inserted into the hole. In order to reinforce the connection between the connecting portion 31 and the support member 2, a detachable connector such as a pin, a bolt and a magnetic structure may be arranged between the connecting portion 31 and the support member 2 for reinforcement.

In the description of this specification, descriptions with reference to the terms such as "an embodiment", "some embodiments", "example", "specific example", or "some examples" mean that specific features, structures, materials, or characteristics described with reference to the embodiment or example are included in at least one embodiment or example of the present application. Moreover, the specific features, structures, materials or characteristics described can be combined in any one or more embodiments or examples in any suitable manner. In addition, without any contradiction, a person skilled in the art may bind and combine different embodiments or examples and features of the different embodiments or examples in the description.

In addition, the terms "first" and "second" are used for descriptive purposes only, and cannot be construed as indicating or implying relative importance or implicitly indicating the number of technical features indicated. Thus, the features defined with "first" and "second" may explicitly or implicitly include at least one of the features. In the description of the present application, the meaning of "a plurality of" is two or more, unless explicitly and specifically defined otherwise.

The above descriptions are merely specific implementations of the present application, but are not intended to limit the scope of protection of the present application. Any variation or replacement readily figured out by a person skilled in the art within the technical scope disclosed in the present application shall fall within the scope of protection of the present application. Therefore, the scope of protection of the present application shall be subject to the scope of protection of the claims.

What is claimed is:

1. A net frame structure with an adjustable net height, the net frame structure comprising:

a net, a suspending member being provided on each of left and right sides of the net; and two support members respectively arranged on the left and right sides of the net in an extended state, wherein each of the support members is provided with a plurality of height positioning portions, the plurality of height positioning portions are sequentially arranged at intervals in a height direction of the support member, a height at which each height positioning portion is located corresponds to a standard height of the net, and the height positioning portion is detachably connected to the suspending member, enabling the net to be maintained at a desired standard height;

wherein the height positioning portion is provided with a limiting groove, the height positioning portion is detachably connected to the suspending member by means of the limiting groove, and the limiting groove is capable of limiting a movement of the suspending member in the height direction of the support member.

2. The net frame structure with an adjustable net height according to claim 1, wherein the suspending member is of a flexible structure and is provided with a suspending hole, the suspending hole penetrates through the suspending member from top to bottom, the suspending hole extends in a left-right direction of the net, and the suspending hole has a first state in which a width of the suspending hole in a front-rear direction of the net is greater than a maximum outer diameter of the height positioning portion and a second state in which the width of the suspending hole in the front-rear direction of the net is less than the maximum outer diameter of the height positioning portion; wherein when the suspending hole is in the first state, the suspending hole allows the height positioning portion to enter and exit therethrough, so as to allow the suspending member to move vertically along the support member; and when the suspending hole is in the second state, the suspending member is detachably connected to the limiting groove, so as to limit the movement of the suspending member in the height direction of the support member.

3. The net frame structure with an adjustable net height according to claim 2, wherein the height positioning portion comprises:

an upper limiting portion, the upper limiting portion having a greater outer diameter than the support member; and a lower limiting portion, the lower limiting portion having a greater outer diameter than the support member, and the lower limiting portion and the upper limiting portion being arranged spaced apart from each other in the height direction of the support member to form the limiting groove.

4. The net frame structure with an adjustable net height according to claim 3, wherein the outer diameter of the upper limiting portion is gradually increased from top to bottom, and the outer diameter of the lower limiting portion is gradually increased from bottom to top.

5. The net frame structure with an adjustable net height according to claim 2, wherein the support member has a first state in which an upper portion of the support member is close to the net in the left-right direction of the net and a second state in which the upper portion of the support member is away from the net in the left-right direction of the net, and the support member is maintained in the second state under the action of the elasticity of the support member;

when the support member is in the first state, the net is slacked, allowing the suspending hole to move vertically along the support member; and when the support member is in the second state, the net is tensioned to cause the suspending member to be connected to the limiting groove.

6. The net frame structure with an adjustable net height according to claim 1, wherein the suspending member is located at an upper end of the net;

a tension rope is arranged at each of lower ends of two sides of the net in the left-right direction, a support portion is arranged on each support member, and the support portion is connected to a corresponding tension rope; and when the suspending member is connected to the height positioning portion, and the tension rope is connected to the support portion, the net is tensioned.

7. The net frame structure with an adjustable net height according to claim 6, wherein the tension rope is of a length adjustable structure, and the tension rope is movably connected to the support portion.

8. The net frame structure with an adjustable net height according to claim 7, wherein the tension rope comprises:

an adjustment tension buckle, the adjustment tension buckle being provided with a plurality of perforations, and the plurality of perforations being sequentially arranged in a vertical direction; and a rope body, the rope body having a first connection section, a second connection section and a third connection section, wherein a head end of the first connection section is connected to the net, a tail end of the first connection section is connected to a head end of the second connection section, the second connection section is staggered from top to bottom and movably threaded in the plurality of perforations, a tail end of the second connection section is connected to a head end of the third connection section, a tail end of the third connection section is connected to the second connection section, and a portion between the head end and the tail end of the third connection section is movably suspended from the support portion.

9. The net frame structure with an adjustable net height according to claim 1, wherein the net frame structure further comprises:

a bottom frame, the bottom frame being of a telescopic structure that is extendable and retractable in a left-right direction of the net frame structure, wherein a connecting portion is arranged at each of left and right ends of the bottom frame, and each connecting portion is detachably connected to a lower end of a corresponding support member.

* * * * *